US010557245B2

(12) United States Patent
Otto et al.

(10) Patent No.: US 10,557,245 B2
(45) Date of Patent: Feb. 11, 2020

(54) VIBRATORY PILE-DRIVING DEVICE

(71) Applicant: BAUER Maschinen GmbH, Schrobenhausen (DE)

(72) Inventors: Hans-Philipp Otto, Aichach (DE); Wolfgang Kraus, Schrobenhausen (DE); Bernhard Lindermair, Kuehbach (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 15/474,722

(22) Filed: Mar. 30, 2017

(65) Prior Publication Data

US 2017/0284050 A1 Oct. 5, 2017

(30) Foreign Application Priority Data

Apr. 5, 2016 (EP) ..... 16163849

(51) Int. Cl.
*E02D 7/18* (2006.01)
*B06B 1/16* (2006.01)
(Continued)

(52) U.S. Cl.
CPC ..... *E02D 7/18* (2013.01); *B06B 1/16* (2013.01); *E02D 5/02* (2013.01); *E02D 11/00* (2013.01); *E02D 2300/0001* (2013.01)

(58) Field of Classification Search
CPC .. E02D 7/14; E02D 7/18; E02D 11/00; E02D 13/00; E02D 13/005; E02D 13/02; B06B 1/16
(Continued)

(56) References Cited

U.S. PATENT DOCUMENTS 3,477,237 A * 11/1969 Orkney ..... E02D 7/18 173/49
3,612,188 A * 10/1971 Ono ..... E02D 7/18 173/122
(Continued)

FOREIGN PATENT DOCUMENTS

CN 104806175 A 7/2015
DE 39 31 366 A1 3/1991
(Continued)

OTHER PUBLICATIONS

The extended European search report issued by the European Patent Office dated Sep. 22, 2016, which corresponds to EP16 16 3849.
(Continued)

*Primary Examiner* — Benjamin F Fiorello
*Assistant Examiner* — Stacy N Lawson
(74) *Attorney, Agent, or Firm* — Studebaker & Brackett PC

(57) ABSTRACT

The invention relates to a vibratory pile-driving apparatus having a carrier implement with a mast, on which, for the purpose of generating vibrations, a vibration generator with a transmission housing is supported, in which at least one pair of rotatably supported unbalanced units is arranged that are driven in a rotating manner by at least one rotary drive. According to the invention provision is made in that the transmission housing is surrounded by a soundproof housing, in which the transmission housing is supported by way of damping elements, and in that from the transmission housing at least one oil supply line and one oil discharge line are led out of the soundproof housing, wherein transmission oil can be cooled outside the soundproof housing.

12 Claims, 5 Drawing Sheets

(51) Int. Cl.
*E02D 11/00* (2006.01)
*E02D 5/02* (2006.01)

(58) Field of Classification Search
USPC ..... 405/232; 173/162.1, 210
See application file for complete search history.

(56) References Cited

U.S. PATENT DOCUMENTS 3,750,765 A * 8/1973 Shelbourne ..... E02D 13/00 173/130
4,039,167 A * 8/1977 Zinga ..... B06B 1/16 366/125
4,124,987 A * 11/1978 Hallman ..... E02D 13/00 173/DIG. 2
4,308,924 A * 1/1982 Boguth ..... E02D 11/00 173/135
4,625,811 A * 12/1986 Tuenkers ..... E02D 7/18 173/112
4,819,740 A * 4/1989 Warrington ..... E02D 7/00 173/162.1
7,080,958 B1 * 7/2006 Morris ..... E02D 7/18 173/162.1
7,392,855 B1 * 7/2008 White ..... E02D 7/10 173/135
2008/0279638 A1 * 11/2008 Hoess ..... B06B 1/186 405/274
2011/0008111 A1 * 1/2011 Jinnings ..... E02D 5/04 405/232
2014/0245845 A1 * 9/2014 Evarts ..... B06B 1/16 74/61
2015/0197910 A1 * 7/2015 Park ..... E02D 7/18 173/49
2015/0211206 A1 * 7/2015 Otto ..... E02F 3/3654 173/184
2015/0275459 A1 * 10/2015 Heichel ..... E02D 7/18 405/232

FOREIGN PATENT DOCUMENTS

EP 2 902 582 A1 8/2015
FR 2 775 732 A1 9/1999
FR 2775732 A1 * 9/1999
GB 1421861 A * 1/1976 ..... E02D 13/00
GB 2 049 033 A 12/1980
JP 58135228 A * 8/1983

OTHER PUBLICATIONS

An Office Action mailed by the State Intellectual Property Office of the People's Republic of China dated Nov. 26, 2018, which corresponds to Chinese Patent Application No. 201710217148.4 and is related to U.S. Appl. No. 15/474,722; with English language translation.

* cited by examiner

VIBRATORY PILE-DRIVING DEVICE

BACKGROUND OF THE INVENTION

The invention relates to a vibratory pile-driving apparatus having a carrier implement with a mast, on which, for the purpose of generating vibrations, a vibration generator with a transmission housing is supported, in which at least one pair of rotatably supported unbalanced units is arranged that are driven in a rotating manner by at least one rotary drive, in accordance with the detailed description hereinbelow.

FIELD OF THE INVENTION

Vibratory pile-driving apparatuses of such type are provided, in particular, for driving and extracting sheet piles into or out of the ground. As a result of the generated vibrations that are caused by unbalanced units driven in a rotating manner the ground is brought into a virtually liquid state so that a pile or beam can be pressed into the ground with relatively little force.

BRIEF SUMMARY OF THE INVENTION

The unbalanced units are driven in a rotating manner by one or several rotary drives using gear transmissions. The unbalanced units and the gear transmission are arranged in a transmission housing, which is filled with transmission oil to reduce friction and frictional heat. Heat developing during the operation of the vibratory pile-driving apparatus is radiated via the metal transmission housing to the surrounding environment. However, via the transmission housing structure-borne sound is also emitted to the environment. Such a noise radiation is particularly undesirable in the case of works taking place in an inner city area.

It is known that the sound radiation occurring on vibration generators is reduced by various individual damping measures.

The invention is based on the object to provide a vibratory apparatus which, whilst having as low a noise radiation as possible, can still be operated efficiently.

In accordance with the invention the object is achieved by a vibratory pile-driving apparatus having the features of the detailed description hereinbelow. Preferred embodiments of the invention are stated in the detailed description hereinbelow.

The vibratory apparatus according to the invention is characterized in that the transmission housing is surrounded by a soundproof housing, in which the transmission housing is supported by way of damping elements, and in that from the transmission housing at least one supply line and one oil discharge line are led out of the soundproof housing, wherein transmission oil can be cooled outside the soundproof housing.

A basic idea of the invention resides in the fact that the transmission housing is surrounded completely or at least in substantial parts by a soundproof housing. The transmission housing with the noise-generating unbalanced units is supported in the soundproof housing by way of damping elements. Through this, a direct transmission of structure-borne sound by the transmission housing to the surrounding air is largely prevented by the soundproof housing provided.

At the same time, the problem of a possible heat build-up in the transmission housing is taken into account in that at least one oil supply line and one oil discharge line are led from the transmission housing out of the soundproof housing, wherein transmission oil can be cooled outside the soundproof housing.

According to a further development of the invention a particularly good noise damping is achieved in that the soundproof housing is provided with a soundproof layer. The soundproof housing can consist of sheet metal, on the external side or preferably the internal side of which the soundproof layer is arranged. By preference, the soundproof layer can be a rubber material or a cellular foam material with good soundproofing properties. The mast can be designed as a leader or an extension arm.

According to an embodiment of the invention a further reduction of the noise radiation is attained in that the damping elements have dampers of a rubber material. In this way, the direct transmission of structure-borne sound from the transmission housing to the soundproof housing is reduced further. By arranging a plurality of damping elements an elastic and at the same time stable damping support of the transmission housing in the soundproof housing can be accomplished.

Basically, the unbalanced units can be driven in a rotating manner by any chosen drive. According to a further development of the invention it is preferred that the at least one rotary drive is a hydraulic motor. The hydraulic motor is arranged directly on or in the transmission housing. The supply of hydraulic fluid takes place via a corresponding hydraulic pump that is arranged away from the hydraulic motor on the carrier implement of the vibratory apparatus. By way of a hydraulic fluid supply and a hydraulic fluid discharge the hydraulic motor is connected to the carrier implement and the further hydraulic units.

A preferred embodiment of the invention resides in the fact that as transmission oil for the transmission housing hydraulic oil is provided, with which the rotary drive is also operated. Hence, the same oil is used both as hydraulic fluid and as transmission oil. This facilitates the supply of the corresponding hydraulic oil to the hydraulic motor and the transmission housing.

A preferred further development of the invention resides in the fact that the hydraulic oil from the transmission housing and the hydraulic oil from the hydraulic motor is returned to a joint hydraulic oil tank which is arranged on the carrier implement. After having passed through the hydraulic drive the hydraulic oil is substantially unpressurized so that it can be discharged together with the hydraulic oil from the vibration generator to the carrier implement. For this, separate oil lines or a joint return line can be provided. During the return flow of the hydraulic oil from the transmission housing into a relatively large unpressurized hydraulic oil tank the hydraulic oil heated up in the transmission housing already experiences a substantial cooling-down. According to a further development of the invention it is preferred that the hydraulic oil tank is connected to a cooling means. The cooling means can be an oil cooler with corresponding cooling fins, by which heat can be emitted to the environment. Basically, provision can also be made for an active cooling means. From the hydraulic oil tank the cooled-down hydraulic oil can be led back to the hydraulic motor, and in particular back to the transmission housing. This can take place via a joint or separate line. When a joint line is used the transmission oil is reduced in its pressure by an appropriate throttle valve so that it can then be led in a substantially unpressurized manner into the transmission housing.

Another preferred embodiment of the invention resides in the fact that the soundproof housing has at least one lockable access door. The access door can be provided, in particular, in a front or lateral area to allow access to the hydraulic drives in the soundproof housing in particular. The access door is also provided, at least on the internal side, with a soundproof covering. By preference, the soundproof housing has an opening on its upper side. Through this, a sound radiation in the upward direction can take place which puts less strain on the environment. Moreover, an opening in the upper area allows for a dissipation of heat and thus a reliable prevention of a heat build-up. The soundproof housing can in particular be of tub-like design so that only an opening exists on the upper side and therefore a possibility for sound and heat to emerge therefrom. In the area of the open upper side oil lines can preferably run in an arched or curved manner, whereby heat dissipation is improved.

Furthermore, it is preferred that the soundproof housing has a guide means, with which the vibration generator is guided in a displaceable manner along the mast. On the front side of the mast a linear guide is arranged, to which the guide means and in particular guide shoes on the soundproof housing correspond. The soundproof housing is furthermore connected to a positioning means for movement along the mast. The positioning means can be a hydraulic cylinder or preferably a feed winch with a rope which is guided over a mast head and fixed on the upper side of the vibration generator. Additionally or alternatively, a feed carriage, to which the vibration generator is coupled, can be guided on the mast.

According to an embodiment variant of the vibratory apparatus according to the invention it is of advantage that on an underside of the transmission housing a holding unit for clamping and holding a driving material is mounted and that the soundproof housing is spaced from the holding unit through the formation of an annular gap that is covered by an elastic cover element. The holding unit is a clamping collet in particular which is designed for clamping and for transmitting vibrations to a sheet pile or another driving material to be driven in. This holding unit is not in direct contact with the soundproof housing. In fact, the holding unit is spaced from the soundproof housing by an annular gap. This gap is covered by an elastic cover element so that no direct sound radiation can arise from this gap.

In this connection it is especially preferred that the cover element is designed as a bellows which is fixed on the one hand on the soundproof housing and on the other hand on the holding unit. The bellows shows a certain flexibility, allowing it to reliably follow the vibratory movements of the holding unit.

Another preferred embodiment of the invention resides in the fact that in an upper area of the soundproof housing a quick-coupling unit for the oil discharge line and the oil supply line is arranged. Hence, despite the external oil cooling there is the possibility of easily uncoupling the vibration generator from the carrier implement and the mast for maintenance purposes. The quick-coupling unit has corresponding coupling plugs that close the oil lines in a leak-free manner when the coupling unit is released. The corresponding coupling counterparts of the quick-coupling unit are arranged on a feed carriage that is supported in a movable manner along the mast. Thus, despite the external cooling a high flexibility is still reached during maintenance works without running the risk of environmental pollution.

According to an embodiment variant of the invention a further reduction of sound radiation is achieved in that on the external side of the soundproof housing at least one connecting means with a support surface is provided, on which a damping covering is arranged. The damping covering can be a rubber element or another cellular foam or plastic element. The connecting means preferably serves as a support for a catch of a driving material safety chain on the clamping collet. The driving material safety chain reliably prevents an accidental dropping of a sheet pile from the holding unit. The connecting means can be provided with a quick-release connecting element, such as screw or hook closures, or form part of the quick-release coupling unit.

BRIEF DESCRIPTION OF THE SEVERAL VIEWS OF THE DRAWINGS

The invention is described further hereinafter by way of a preferred embodiment illustrated schematically in the accompanying drawings, wherein show.

DETAILED DESCRIPTION OF THE INVENTION

Figure 5:
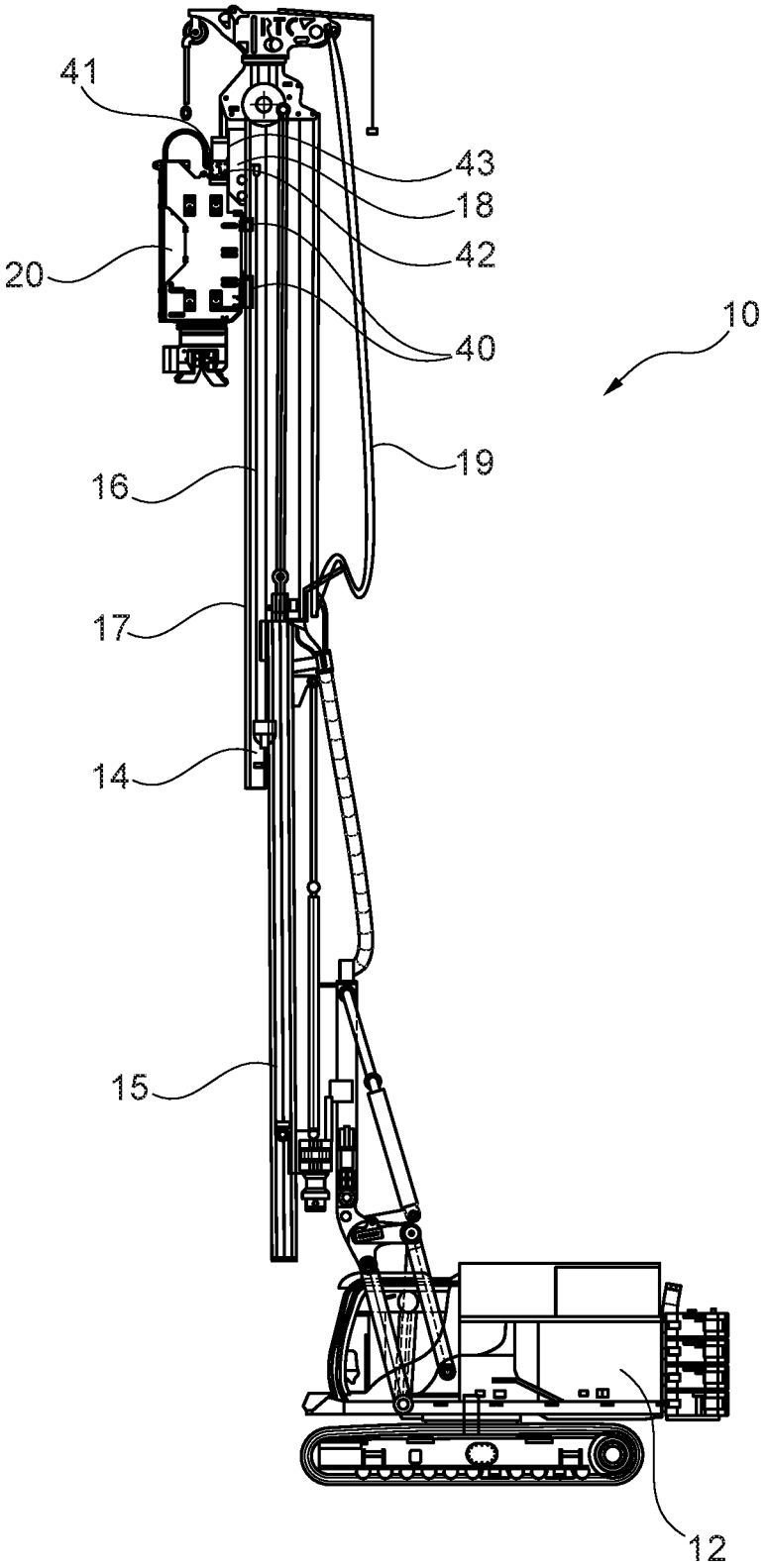
FIG. 5 a side view of a vibratory pile-driving apparatus according to the invention.

According to FIG. 5 a vibratory pile-driving apparatus 10 pursuant to the invention has a carrier implement 12 which comprises in a known manner a crawler-track running gear as an undercarriage and an upper carriage arranged thereon in a rotatable manner. On the upper carriage of the carrier implement 12 a mast 14 is linked in a pivotable manner which is designed as a leader with a lower mast part 15, along which an upper mast part 16 is guided in a vertically movable manner. Along a front side of the upper mast part 16 a linear guide 17 is designed, along which a vibration generator 20 according to the invention is guided by a guiding means 40.

On its upper side the vibration generator 20 is releasably coupled via a quick-coupling 41 to a feed carriage 18 that can be moved via a feed means along the linear guide 17 of the upper mast part 16. To form the quick-coupling 41 a lower quick-coupling unit 42 is arranged on the vibration generator 20, which establishes a connection with an upper quick-coupling unit 43 on the feed carriage 18. Via lines 19 hydraulic oil can be led from the carrier implement 12 along the mast 14 up to the vibration generator 20.

Figure 1:
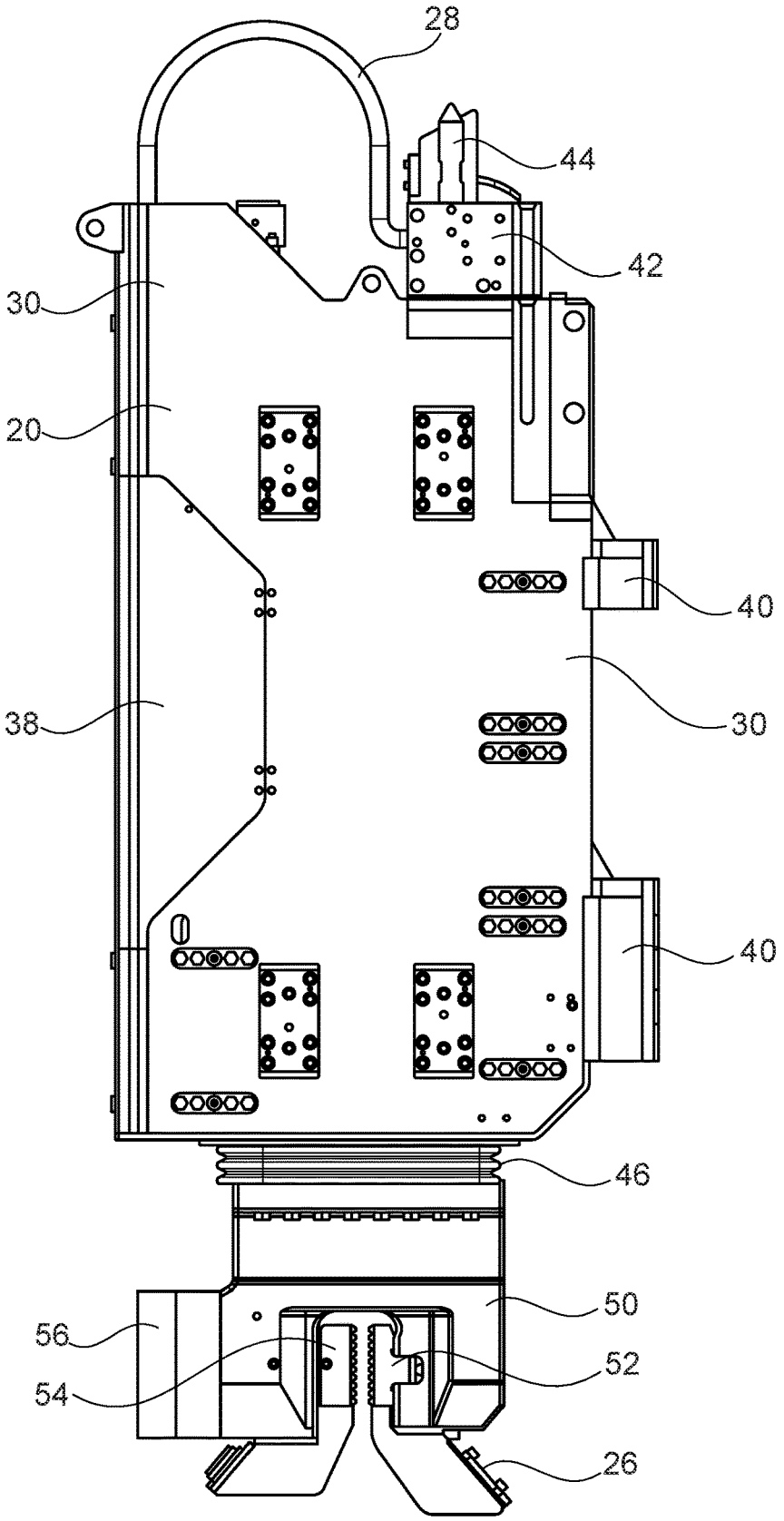
FIG. 1 a side view of a vibration generator according to the invention.
Figure 2:
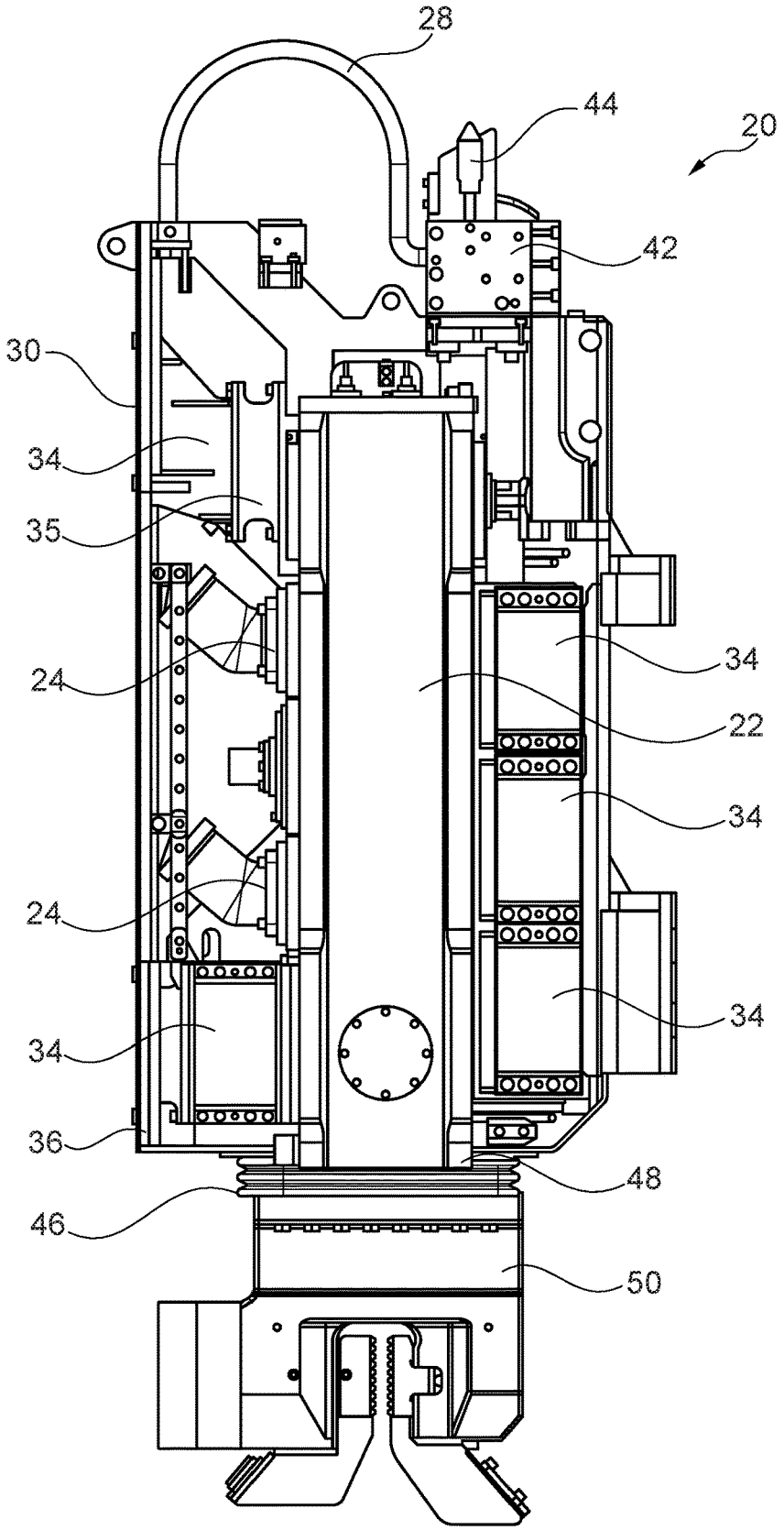
FIG. 2 a cross-sectional view of the vibration generator according to the invention of FIG. 1.
Figure 3:
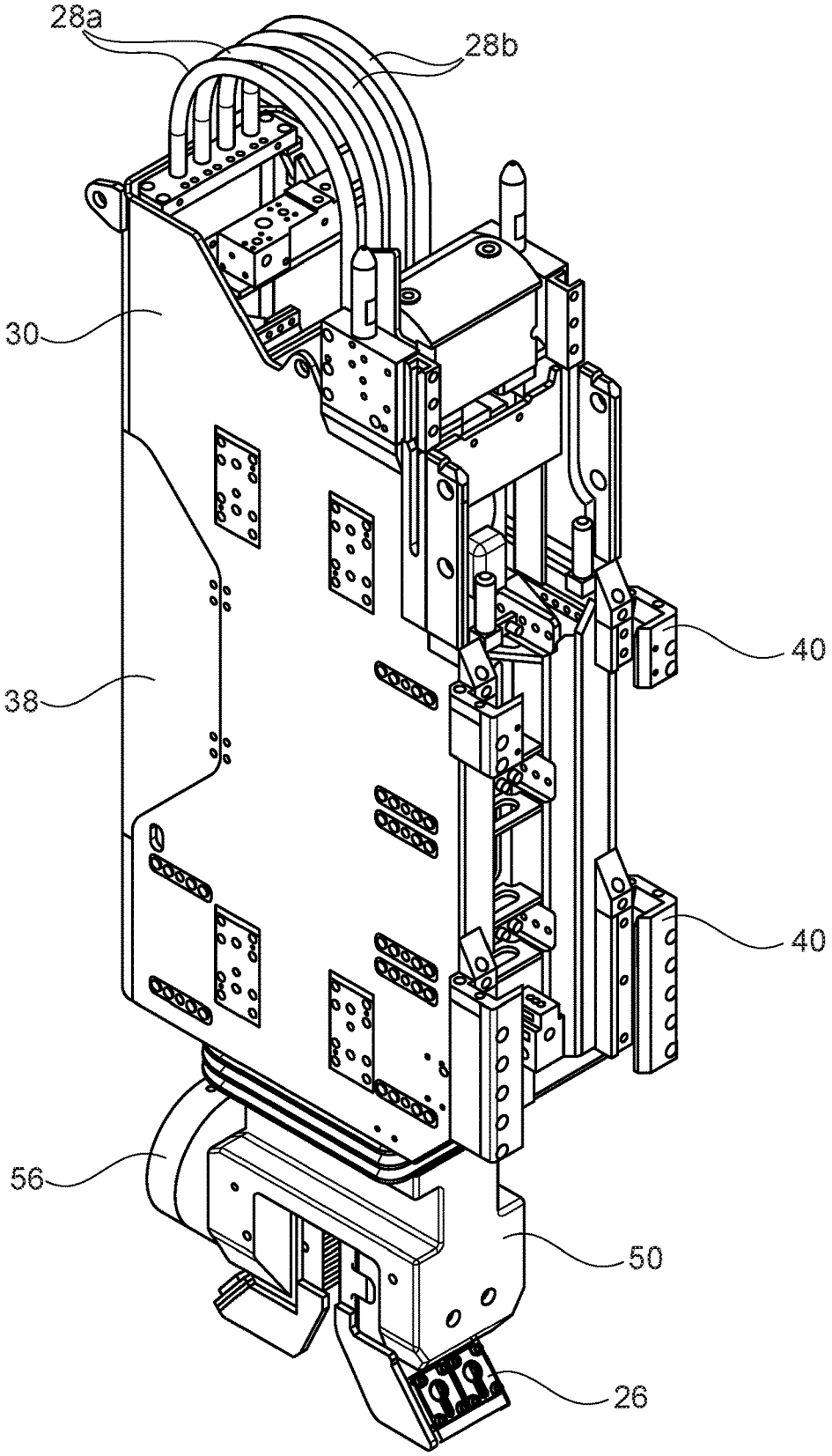
FIG. 3 a perspective view of the vibration generator of FIG. 1 and FIG. 2.

The construction of a vibration generator 20 according to the invention is explained in greater detail in conjunction with FIGS. 1 to 3. The vibration generator 20 has an internal transmission housing 22, in which two pairs of rotating unbalanced units are supported that are driven in a rotating manner by two lateral rotary drives 24. The rotary drives 24 are designed as hydraulic motors. Through the rotating unbalanced units the transmission housing 22 is set into vibration. At the lower end of the transmission housing 22 a holding unit 50 for beams, in particular sheet piles, to be driven in or extracted is firmly mounted. For this purpose, the holding unit 50 has a stationary clamping jaw 52 and a clamping jaw 54 movable relative thereto which is moved linearly by a lateral clamping cylinder 56 in order to clamp the sheet pile. As a slipping through protection for the sheet pile a connecting means 26, which will be explained in greater detail at a later stage, is arranged laterally on the stationary clamping jaw 52.

To reduce sound radiation the transmission housing 22 is surrounded to a large degree by a soundproof housing 30. The transmission housing 22 is connected to the external soundproof housing 30 by means of several damping elements 34 which each have a damper 35 of a rubber material.

The soundproof housing 30 is formed of sheet metal, on the internal side of which a soundproof layer 36 is arranged. Due to its elastic support the transmission housing 22 is able to vibrate freely in the soundproof housing 30 and transfer the vibration to the holding unit 50. The holding unit 50 is spaced from the soundproof housing 30 through the formation of an annular gap 48. To prevent sound radiation by the gap 48 this is covered by a flexible cover element 46 that is designed as a bellows. To form an access to the internal transmission housing 22 a removable access door 38 is provided on a front side of the soundproof housing 30 of the vibration generator 20.

By way of a bracket-like guide means 40 on the soundproof housing 30 the vibration generator 20 is supported in a displaceable manner along the mast 14. On the upper side of the soundproof housing 30 a lower quick-coupling unit 42 of the quick-coupling 41 is arranged in order to firmly connect the vibration generator 20 to a feed carriage 18 on the mast 14. For this purpose, a corresponding upper quick-coupling unit 43 is arranged on the feed carriage 18. By way of suitable plug-in coupling elements 44 a leak-free connection of oil lines can be effected.

To provide the rotary drives 24 with hydraulic oil and to supply and discharge oil to and from the transmission housing 22 oil supply lines 28*a* and oil discharge lines 28*b* are led in an arched manner through an opening in the upper area of the soundproof housing 30 out of the said soundproof housing 30 towards the lower coupling unit 42. In this way, hydraulic oil, which is also at the same time transmission oil for lubrication of the transmission elements in the transmission housing 22, can be led via the quick-coupling 41 to the lines 19, with which oil can be led to the hydraulic units and a hydraulic oil tank on the upper carriage of the carrier implement 12. By thus leading the oil an adequate cooling of the oil in the transmission housing 22 is also ensured despite the fact that the transmission housing 22 is surrounded by a soundproof housing 30.

Figure 4:
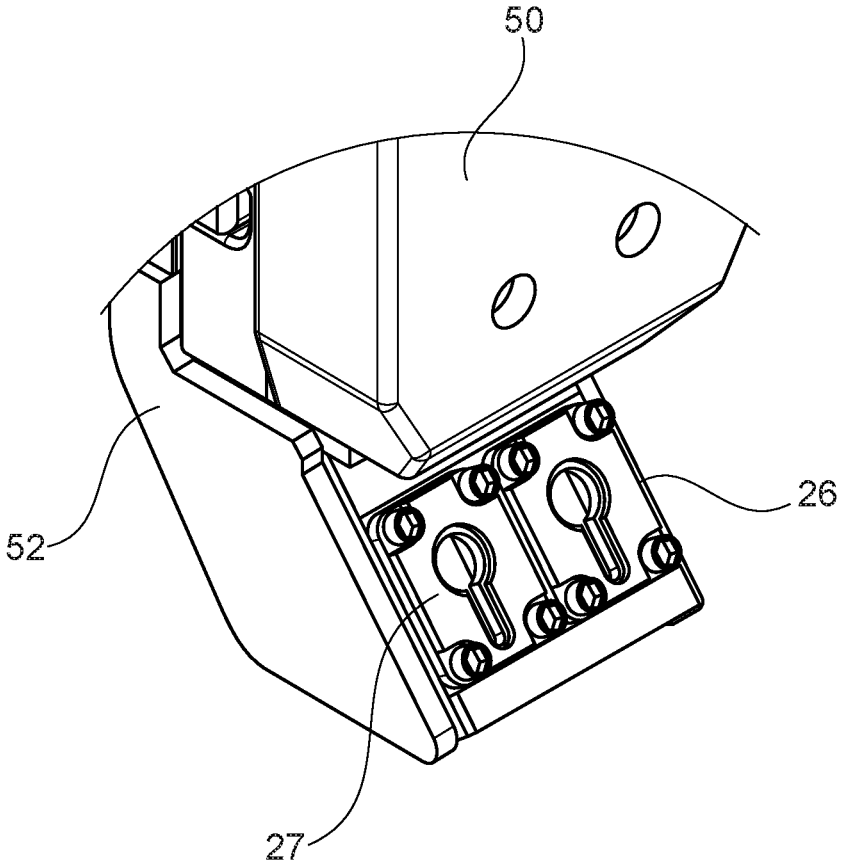
FIG. 4 a detailed view of a connecting means of the vibration generator of FIG. 3.

According to FIG. 4 a holding means 26 for a safety chain is provided on the stationary clamping jaw 52 in a rear area. The safety chain is connected to the sheet pile, in which case a corresponding linkage of the safety chain to the connecting means 26 ensures that even in the case of failure of the holding unit 50 the sheet pile does not hit the ground in an uncontrolled manner. To avoid sound radiation by the safety chain a damping covering 27 is arranged on a support surface on the plug-lock-like connecting means 26. Through this, a direct transmission of vibrations from the holding unit 50 to the safety chain is reduced considerably.

The invention claimed is:

1. A vibratory pile-driving apparatus comprising:
a carrier implement with a mast;
a vibration generator for the purpose of generating vibrations, the vibration generator comprising:
a transmission housing;
at least one pair of rotatably supported unbalanced units arranged in the transmission housing; and
at least one rotary drive, which is a hydraulic motor;
a soundproof housing;
damping elements;
at least one oil supply line;
at least one oil discharge line;
hydraulic/transmission oil; and
a joint hydraulic/transmission oil tank, which is arranged on the carrier implement,
wherein
the at least one pair of rotatably supported unbalanced units is driven in a rotating manner by the at least one rotary drive,
the transmission housing is substantially surrounded by the soundproof housing,
the transmission housing is supported within the soundproof housing by the damping elements,
the at least one oil supply line and the at least one oil discharge line are led out of the soundproof housing,
the vibratory pile-driving apparatus is configured to cool the hydraulic/transmission oil outside the soundproof housing,
the hydraulic/transmission oil flows inside the hydraulic motor,
the hydraulic/transmission oil flows inside the transmission housing,
the hydraulic/transmission oil flows between the hydraulic motor and the joint hydraulic/transmission oil tank and between the transmission housing and the joint hydraulic/transmission oil tank,
on an underside of the transmission housing, a holding unit for clamping and holding a driving material is mounted,
the soundproof housing is spaced from the holding unit through an annular gap that is covered by an elastic cover element, and
the cover element is designed as a bellows with a first end fixed on the soundproof housing and a second end fixed on the holding unit.

2. The vibratory pile-driving apparatus according to claim 1,
wherein
the soundproof housing is provided with a soundproof layer.

3. The vibratory pile-driving apparatus according to claim 1,
wherein
the damping elements have dampers of a rubber material.

4. The vibratory pile-driving apparatus according to claim 1,
wherein
the joint hydraulic/transmission oil tank is connected to a cooler.

5. The vibratory pile-driving apparatus according to claim 1,
wherein
the soundproof housing has at least one lockable access door.

6. The vibratory pile-driving apparatus according to claim 1,
wherein
in an upper area of the soundproof housing, a quick-coupling unit for the at least one oil discharge line and the at least one oil supply line is arranged.

7. The vibratory pile-driving apparatus according to claim 1,
wherein
the hydraulic/transmission oil is circulated to the transmission housing and the at least one rotary drive, the hydraulic/transmission oil is conveyed from the transmission housing and returned to the joint hydraulic/transmission oil tank via the at least one oil discharge line, and the hydraulic/transmission oil is conveyed from the at least one rotary drive and returned to the joint hydraulic/transmission oil tank via the at least one oil discharge line.

8. The vibratory pile-driving apparatus according to claim 1, wherein the at least one rotary drive is provided between the transmission housing and the soundproof housing.

9. A vibratory pile-driving apparatus comprising:

a carrier implement with a mast;

a vibration generator for the purpose of generating vibrations, the vibration generator comprising:

a transmission housing;

at least one pair of rotatably supported unbalanced units arranged in the transmission housing; and at least one rotary drive, which is a hydraulic motor;

a soundproof housing;

damping elements;

at least one oil supply line;

at least one oil discharge line;

hydraulic/transmission oil; and a joint hydraulic/transmission oil tank, which is arranged on the carrier implement, wherein the at least one pair of rotatably supported unbalanced units is driven in a rotating manner by the at least one rotary drive, the transmission housing is substantially surrounded by the soundproof housing, the transmission housing is supported within the soundproof housing by the damping elements, the at least one oil supply line and the at least one oil discharge line are led out of the soundproof housing, the vibratory pile-driving apparatus is configured to cool the hydraulic/transmission oil outside the soundproof housing, the at least one rotary drive is provided between the transmission housing and the soundproof housing, the soundproof housing has a guide that guides the vibration generator in a displaceable manner along the mast, the hydraulic/transmission oil flows between the hydraulic motor and the joint hydraulic/transmission oil tank and between the transmission housing and the joint hydraulic/transmission oil tank, on an underside of the transmission housing, a holding unit for clamping and holding a driving material is mounted, the soundproof housing is spaced from the holding unit through an annular gap that is covered by an elastic cover element, and the cover element is designed as a bellows with a first end fixed on the soundproof housing and a second end fixed on the holding unit.

10. The vibratory pile-driving apparatus according to claim 9, wherein the hydraulic/transmission oil flows inside the hydraulic motor, and the hydraulic/transmission oil flows inside the transmission housing.

11. A vibratory pile-driving apparatus comprising:

a carrier implement with a mast;

a vibration generator for the purpose of generating vibrations, the vibration generator comprising:

a transmission housing;

at least one pair of rotatably supported unbalanced units arranged in the transmission housing; and at least one rotary drive, which is a hydraulic motor;

a soundproof housing;

damping elements;

at least one oil supply line;

at least one oil discharge line;

hydraulic/transmission oil; and a joint hydraulic/transmission oil tank, which is arranged on the carrier implement, wherein the at least one pair of rotatably supported unbalanced units is driven in a rotating manner by the at least one rotary drive, the transmission housing is substantially surrounded by the soundproof housing, the transmission housing is supported within the soundproof housing by the damping elements, the at least one oil supply line and the at least one oil discharge line are led out of the soundproof housing, the vibratory pile-driving apparatus is configured to cool the hydraulic/transmission oil outside the soundproof housing, the at least one rotary drive is provided between the transmission housing and the soundproof housing, at least one connector with a support surface is provided on an external side of the soundproof housing, and a damping covering is arranged on the support surface, the hydraulic/transmission oil flows between the hydraulic motor and the joint hydraulic/transmission oil tank and between the transmission housing and the joint hydraulic/transmission oil tank, on an underside of the transmission housing, a holding unit for clamping and holding a driving material is mounted, the soundproof housing is spaced from the holding unit through an annular gap that is covered by an elastic cover element, and the cover element is designed as a bellows with a first end fixed on the soundproof housing and a second end fixed on the holding unit.

12. The vibratory pile-driving apparatus according to claim 11, wherein the hydraulic/transmission oil flows inside the hydraulic motor, and the hydraulic/transmission oil flows inside the transmission housing.

* * * * *